US010889104B2

(12) United States Patent
Noll et al.

(10) Patent No.: US 10,889,104 B2
(45) Date of Patent: Jan. 12, 2021

(54) METHOD FOR PRODUCING A PRINTED CAN LID

(71) Applicant: Ardagh Metal Beverage Europe GmbH, Zug (CH)

(72) Inventors: Werner Noll, Hübingen (DE); Olaf Joeressen, Meerbusch (DE)

(73) Assignee: ARDAGH METAL BEVERAGE EUROPE GMBH, Zug (CH)

( * ) Notice: Subject to any disclaimer, the term of this patent is extended or adjusted under 35 U.S.C. 154(b) by 210 days.

(21) Appl. No.: 15/995,975

(22) Filed: Jun. 1, 2018

(65) Prior Publication Data

US 2018/0345653 A1 Dec. 6, 2018

(30) Foreign Application Priority Data

Jun. 2, 2017 (DE) ..... 10 2017 112 198

(51) Int. Cl.
*B41M 1/40* (2006.01)
*B41J 3/407* (2006.01)
(Continued)

(52) U.S. Cl.
CPC ..... *B41F 17/22* (2013.01); *B21D 51/26* (2013.01); *B21D 51/383* (2013.01);
(Continued)

(58) Field of Classification Search
CPC ..... B41F 17/18; B41F 17/1716; B41F 17/20; B41F 17/22; B41J 3/407; B41J 3/4073; B41M 1/40
See application file for complete search history.

(56) References Cited

U.S. PATENT DOCUMENTS

2009/0133593 A1* 5/2009 Till ..... B65C 9/46 101/35
2015/0375943 A1* 12/2015 Ellefson ..... B65G 49/00 101/40.1
(Continued)

FOREIGN PATENT DOCUMENTS

DE 102012209500 A1 * 12/2013 ..... B41M 1/40
JP 04216989 A * 8/1992 ..... B41J 3/4073
(Continued)

OTHER PUBLICATIONS

English language translation of JP 04216989A, publication date Aug. 7, 1992. (Year: 1992).*

*Primary Examiner* — Leslie J Evanisko
(74) *Attorney, Agent, or Firm* — Knobbe, Martens, Olson & Bear, LLP

(57) ABSTRACT

A method for manufacturing a printed can lid (1) of a can with a digital printing method; comprising at least the following steps:

a) making available a shell (2) with an outer face (3) and an inner face (4);
b) making available a control unit (9) and a printed image (8), wherein the printed image (8) can be processed in the control unit (9);
c) making available at least a first digital printing unit (10) with at least one printing head (11); wherein the printed image (8) which is made available by the control unit (9) can be printed onto the outer face (3) with the printing head (11); and
d) printing the printed image (8) which is made available by the control unit (9) onto the outer face (3) with the printing head (11).

12 Claims, 2 Drawing Sheets

(51) Int. Cl.

| | |
|---|---|
| ***B41F 17/22*** | (2006.01) |
| ***B41J 11/00*** | (2006.01) |
| ***B41J 3/413*** | (2006.01) |
| ***B65D 17/28*** | (2006.01) |
| ***B21D 51/26*** | (2006.01) |
| ***B21D 51/38*** | (2006.01) |
| ***B41F 15/08*** | (2006.01) |
| ***B41F 17/18*** | (2006.01) |
| ***B65D 17/50*** | (2006.01) |

(52) U.S. Cl.

CPC ..... *B41F 15/0872* (2013.01); *B41F 17/18* (2013.01); *B41J 3/413* (2013.01); *B41J 11/002* (2013.01); *B41J 11/007* (2013.01); *B41J 11/008* (2013.01); *B41J 11/0095* (2013.01); *B65D 17/4012* (2018.01); *B65D 17/502* (2013.01); *B65D 2203/02* (2013.01); *B65D 2517/0062* (2013.01)

(56) References Cited

U.S. PATENT DOCUMENTS

2016/0159119 A1* 6/2016 Albonetti ..... B41J 3/4073
347/102
2019/0084714 A1* 3/2019 Lindner ..... B41J 11/0095

FOREIGN PATENT DOCUMENTS

JP 2003011342 A * 1/2003
WO WO-2015011663 A1 * 1/2015 ..... B41J 11/0015

* cited by examiner

METHOD FOR PRODUCING A PRINTED CAN LID

FIELD

The invention relates to a method and a device for manufacturing a printed can lid for a can, in particular for a beverage can.

BACKGROUND

Can lids for beverage cans are usually permanently connected, for example by flanging, to a can body into which a beverage is filled. The cylindrical outer walls of can bodies are often printed, e.g. with coloured patterns, decorations or information. However, there is also a need to provide the can lid with such patterns, decorations or information.

WO 2004/110877 A2 discloses applying a printed protective film to a can lid, wherein the protective film has a notch or punched line which facilitates manual removal of at least one part of the protective film before the content of the beverage can is consumed by a person.

WO 2007/007102 A2 and U.S. Pat. No. 6,524,048 B1 discloses printing can lids. However, the known methods for manufacturing printed can lids are time-consuming and costly and can give rise to quality problems.

SUMMARY

The object of the invention is therefore to at least partially solve the existing problems relating to the prior art and, in particular, to specify a method and a device for manufacturing a printed can lid for a can which reduces or eliminates one or more of the abovementioned disadvantages.

These objects are achieved with the methods summarized below. It is to be noted that the features which are disclosed individually can be combined with one another in a technologically appropriate way and define further embodiments of the invention. The features are described and explained in more detail in the description, with further preferred refinements of the invention being presented.

Some examples relate to a method for manufacturing a printed can lid of a can with a digital printing method contributes to this. The method including at least the following steps:

a) making available a shell with an outer face and an inner face;

b) making available a control unit and a printed image, wherein the printed image can be processed in the control unit;

c) making available at least a first digital printing unit with at least one printing head; wherein a printed image which is made available by the control unit can be printed onto the outer face with the printing head; and d) printing the printed image which is made available by the control unit onto the outer face with the printing head.

In some examples, in step a) the shell has, at least on the outer face, at least one structure which predefines a first orientation of the shell, and therefore a first position of a printed image which is to be applied to the outer face; wherein the method includes, before step d), at least the following further steps:

a1) detecting the first orientation of the shell by means of the control unit;

b1) determining a first position of the printed image which is to be applied, as a function of the detected first orientation; and c1) making available a printed image which is generated computationally as a function of the first position in the control unit, for the at least one first digital printing unit;

wherein in step d) the printed image which is made available by the control unit is printed onto the outer face in the first position with the printing head.

In some examples, in step c1) the printed image is rotated computationally by the control unit.

In some examples, in the control unit there are a multiplicity of printed images which are each rotated by a predefined angular value; wherein in step c1) a printed image which is oriented in a way matching the first orientation by the control unit is selected and is made available for the first digital printing unit.

In some examples, the predefined angular values of the printed images which are present in the control unit differ by at maximum 5 angular degrees in each case.

In some examples the structure is an opening element; wherein a removal opening in the can lid can be opened by a user by means of the opening element.

In some examples, the at least one printing head is arranged with respect to the outer face in such a way that at least one partial surface, to be printed, of the outer face is moved at least two millimetres away from the printing head during the printing.

In some examples, the shell has, directly before the printing according to step d), a temperature of at least 40 degrees Celsius.

In some examples, the first digital printing unit includes at least four printing heads, wherein each printing head applies a different printing ink.

In some examples, water-based colours are applied by means of the first digital printing unit.

In some examples, between the steps a1) and d) the shell is fed to the first digital printing unit in a feed direction, wherein only before step a1) the shell is moved in a lateral direction, perpendicularly with respect to the feed direction, and is aligned therewith.

In some examples, after step d) the shell is fed to a pad-printing unit, wherein the printed image is coated over by means of the pad-printing unit.

In some examples, before step d) the shell is at least partially printed with a white printing ink by means of a printing unit or by means of a second digital printing unit.

Some examples relate to a device for manufacturing a printed can lid of a can with a digital printing method; wherein a shell has an outer face and an inner face; wherein the device includes at least:

(1) a control unit for processing the printed image;

(2) a feed unit for feeding the shell in a feed direction;

(3) a first digital printing unit with at least one printing head with which the printed image which is made available by the control unit can be printed onto the outer face.

In some examples, the shell has, at least on the outer face, at least one structure which predefines a first orientation of the shell and therefore a first position of a printed image which is to be applied to the outer face; wherein the device additionally includes a sensor unit for detecting the first orientation of the shell on the feed unit by means of the control unit; wherein by means of the control unit it is possible to determine a first position of the printed image as a function of the first orientation of the shell which is detected by means of the sensor unit, and therefore to generate a computationally generated printed image for the first digital printing unit and to apply said printed image to the outer face in the first position with the printing head.

In some examples, the device includes an orientation unit, by means of which the shell can be moved by the sensor unit in a lateral direction, perpendicularly with respect to the feed unit and aligned therewith.

In some examples, the device includes a heating apparatus for heating the shell to a predefinable temperature, with the result that immediately before the printing by means of the printing head the shell is at a temperature of at least 40 degrees Celsius.

BRIEF DESCRIPTION OF THE DRAWINGS

The invention as well as the technical field are explained in more detail below with reference to the figures. It is to be noted that the invention is not intended to be restricted by the exemplary embodiments shown. In particular, unless not explicitly presented otherwise, it is also possible to extract partial aspects of the contents which are explained in the figures and combine them with other components and realizations from the present description and/or figures. Identical reference symbols denote identical objects, with the result that, where appropriate, explanations from other figures can be used in a supplementary fashion. In the drawings, in each case in a schematic form.

DETAILED DESCRIPTION

Figure 1:
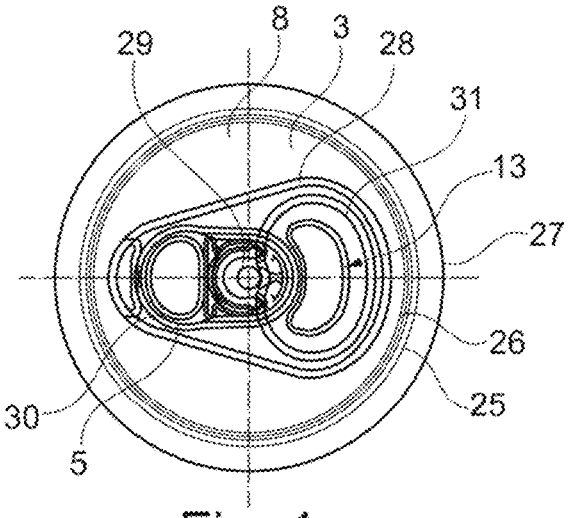
FIG. 1 shows a shell in a plan view.

The method according to the invention provides that firstly a shell (not connected to the can) is made available. The shell has, in particular, an outer face with a central, usually circular, lid base area, and a, likewise usually circular, inner face which lies opposite the lid base area. After the connection of the can lid to a can body to form a beverage can, the inner face of the shell usually faces the interior part of the beverage can, while the outer face is arranged with the lid base area on the outside of the beverage can, which is accessible to a user. Furthermore, the shell usually has a core wall and a core bead formed between the core wall and the lid base area, and on its outer circumference a flange edge for connecting the can lid to a beverage can body. The shell can also have e.g. impressions or beads, preferably for increasing the stability of the can lid.

In particular, the shell has at least one structure such as e.g. an opening element which is provided for the opening of the beverage can by a user. The activation of the opening element usually causes an opening in the lid of the can, through which lid a content of the can can be removed from the can.

The printing which is proposed here generally includes the outer face and/or the side of the can lid which surrounds the lid base area. The printed image can (also) be printed, in particular, onto the structure, the core wall, the core bead and/or the flange edge. The outer face and/or the side of the can lid which surrounds the lid base area can also be only partially printed.

In step b), a control unit and a printed image which is to be applied to the shell are made available, wherein the printed image can be processed in the control unit. The control unit therefore comprises e.g. a memory or a processor in which the (digital) data of the printed image can be stored and/or processed.

In step c), at least a first digital printing unit with at least one printing head is made available. A printed image which is made available by the control unit can be printed onto the outer face with the printing head.

The term digital printing denotes a group of printing methods in which the printed image is transferred directly from a computer into a printing machine without a static printing plate being used. In particular, in this context the printing head is arranged spaced apart from the surface to which the printed image is to be applied, with the result that contactless printing is carried out. The printing system is, in particular, an ink printing system, e.g. a drop-on-demand printing system or a continuous inkjet printing system. These digital printing methods and the printing devices which are used for them are known.

The first digital printing unit proposed here is such a device for digital printing, wherein the printed image is made available by the control unit. The printing head operates according to the known methods of ink printing as mentioned above.

In particular, further digital printing units can also be provided, and each digital printing unit can also have a plurality of printing heads. In particular, a plurality of printing heads for applying the same printing ink can also be arranged in series in a feed direction and in this case offset laterally with respect to one another here.

The use of a digital printing method permits a high degree of variety or variance of the printed images used. That is to say it is also possible to manufacture shells in small numbers with the same printed images at a reasonable cost.

In step d), the printed image which is made available by the control unit is applied to the outer face with the printing head.

In particular it is proposed that in step a) the shell has, at least on the outer face, at least one structure which predefines a first orientation of the shell, and therefore a first position of a printed image which is to be applied to the outer face; wherein the method comprises, before step d), at least the following further steps:

a1) detecting the first orientation of the shell by means of the control unit;

b1) determining a first position of the printed image which is to be applied, as a function of the detected first orientation; and c1) making available a printed image which is generated computationally as a function of the first position in the control unit, for the at least one first digital printing unit;

wherein in step d) the printed image which is made available by the control unit is printed onto the outer face in the first position with the printing head.

In particular, the shell has at least the structure which predefines a first orientation of the shell and therefore a first position of a printed image which is to be applied to the lid base area. Such a structure is formed e.g. by an opening element which is provided for the opening of the beverage can by a user. The activation of the opening element usually causes an opening in the lid of the can, through which lid a content of the can can be removed from the can.

In step a1), the first orientation of the shell is sensed or detected by means of the control unit. In particular, the sensing or detection of the first orientation is carried out using a sensor unit whose measurement signal is sensed and processed by means of the control unit. An optical sensor (e.g. a camera) by means of which e.g. the position of an opening element is used, can preferably be used here.

In step b1), a first position of the printed image which is to be applied is determined as a function of the detected first orientation of the shell, in particular computationally by means of the control unit.

The first orientation can be a position in relation to the feed direction of the shell (that is to say a lateral offset), a position in relation to a distance of the shell with respect to adjacently arranged shells in the direction of the feed direction or a rotation of the shell.

In step c1), a printed image which is generated (if appropriate rotated) computationally as a function of the first position in the control unit is made available for the at least one first digital printing unit.

In contrast to known methods, the shell is not rotated here (and/or laterally shifted) in such a way that the printed image can always be applied in the same way to the shell. It is proposed in particular here that the printed image be oriented (in a virtual fashion) in the control unit in such a way that it can then be applied with the suitable orientation by means of the printing head to the (if appropriate always differently) oriented shell.

Therefore, in particular a movement of the shell, e.g. a rotation of the shell and/or lateral shifting, is not necessary before the printing. An adaptation of the position of the printing head or of the digital printing unit is also not necessary, since a "rotated data record" or "laterally offset data record", which is made available by the control unit, of the printed image is applied to the shell by the printing head.

A movement of the shell or of the printing head in a transverse direction with respect to the feed direction is therefore also not necessary, since a "laterally offset data record", which is made available by the control unit, of the printed image is applied to the shell.

In step d), the printed image which is made available (and if appropriate rotated) by the control unit is applied to the outer face in the first position with the printing head.

In particular in step c1) the printed image is rotated computationally by the control unit. For this purpose, the control unit sets, in particular, a sufficient computing power, with the result that a corresponding data record of the suitably rotated printed image can be made available within as short a time as possible to the digital printing unit.

In particular it is to be noted that the shells are fed to the first digital printing unit at a speed of at least 30 metres per minute, in particular at least 60 metres per minute. In the time between the sensing of the first orientation in step a1) and the making available of the rotated printed image according to step c1) the shell may have traveled at maximum the distance e.g. between the sensor used in step a1) and the first digital printing unit.

According to another embodiment of the method, in the control unit there are a multiplicity of printed images which are each rotated by a predefined angular value; wherein in step c1) a printed image which is oriented (if appropriate rotated) in a way matching the first orientation is selected and is made available for the digital printing unit by means of the control unit.

In particular, in the control unit there are a multiplicity of printed images which are each laterally offset by a specific amount, wherein in step c1) a printed image which is oriented (if appropriate laterally shifted) in a way matching the first orientation is selected and made available for the digital printing unit by means of the control unit.

In this embodiment of the method, a "computational" rotation (or lateral movement) of the printed image is not necessary but instead the printed image which respectively "matches" best is selected and made available. In this way, the printed image can be made available, in particular, more quickly and, if appropriate, with much less computing power of the control unit. The printed image which is oriented in a way matching the first orientation has, in particular, the smallest deviation (e.g. in angular degrees or in millimetres) with respect to the sensed first orientation of the shell.

In particular, the angular values of the (stored) printed images which are present in the control unit differ by in each case at maximum three (3), preferably by at maximum one (1), particularly preferably by at maximum 0.5 angular degrees.

In particular, the structure is an opening element, wherein a removal opening of the can lid can be opened by a user by means of the opening element.

The at least one printing head is preferably arranged with respect to the outer face or to the shell in such a way that at least one partial surface, to be printed, of the outer face is at least two (2), in particular at least three (3), preferably at least five (5), millimetres away from the printing head during the printing. In particular, this distance of the printing head from the outer face is necessary for no contact to occur between the printing head and the shell in the other areas of the shell, e.g. at places where the structure is arranged.

In particular, the at least one printing head is arranged with respect to the outer face or to the shell in such a way that at least one partial surface, to be printed, of the outer face is at maximum six (6), in particular at maximum seven (7), millimetres away from the printing head during the printing.

In particular, each shell and the at least one printing head are arranged at a fixed distance from one another, i.e. neither the shell nor the at least one printing head are moved relative to one another at least during step d). However, the distance between the printing head and the surface, to be printed, of the shell can change as a function of the shape of the shell. In order to avoid a collision here of the printing head with the shell or e.g. with a structure of the shell, in particular the proposed distance is maintained.

In particular, the shell has, directly before the printing according to step d), a temperature of at least 40, preferably of at least 60, particularly preferably of at least 80, degrees Celsius. In particular, the shell is at a temperature between 40 and 100, preferably between 60 and 100, particularly preferably between 80 and 100, degree Celsius. In particular, a temperature which is increased in this way is helpful here in fixing on the shell the printing ink which has been applied during step d), in particular taking into account the fact that at least partial surfaces of the outer face are arranged at the distance described above from the printing head during the printing.

The first digital printing unit preferably comprises at least four printing heads, wherein each printing head applies a different printing ink. In particular, the printing inks cyan, magenta, yellow and (contrast) black are provided, if appropriate additionally at least one of the following printing inks red, green and blue or additionally hexachrome is provided.

Water-based inks are preferably provided by the first digital printing unit.

In particular, the printing inks should have regulatory approval for use in the food industry (e.g. FDA regulatory approval or regulatory approval by the Nehring Institute) for use with foodstuffs.

In the case of water-based inks, such regulatory approvals are known or possible. Alternatively, UV printing inks without photoinitiators could also be used.

At this particular point after step d) the applied printing ink could be dried by means of an electron beam.

In particular after step d) the applied printing ink is dried by means of heat, e.g. as a result of drying with hot air or of infrared drying.

In particular, between the steps a1) and d) the shell is fed to the first digital printing unit in a feed direction, wherein only before step a1) the shell is moved in a lateral direction, perpendicularly with respect to the feed direction, and is aligned therewith. This movement or orientation in the lateral direction positions the shell under the at least one printing head in such a way that the printed image can be applied in each case in a centred fashion on the shell.

The movement or orientation is carried out, in particular, by means of guide devices or guide rails which shift the shell on the feed unit.

In particular, the printed image can, however, also be made available with a lateral offset by means of the control unit, with the result that shells which are not arranged aligned in the feed direction can be printed with a correctly positioned printed image.

In particular, the feed unit comprises a conveyor belt on which the shells are secured e.g. by means of the application of a partial vacuum. A movement of the shell can then be carried out only with respect to the feed unit by means of external force, e.g. over the guide devices or guide rails.

In particular, after step d) the shell is fed to a pad-printing unit, wherein the printed image is coated over by means of the pad-printing unit.

Pad-printing methods are known, for example, from EP 0 712 724 B1, U.S. Pat. No. 6,158,341 or WO 03/082575 A1 for other fields of application. In the pad-printing method, a printed image is applied to a surface to be printed (the shell) by means of a deformable compression die. The surface to be printed here does not be even but rather can have depressions and elevated portions. This is made possible by the deformable compression die which is composed of a soft elastic material and designed to deform when in contact with a surface to be printed and in this case transfer previously absorbed printing media, e.g. printing inks or surface coating agents, to the surface to be printed.

In particular, the pad-printing unit transfers a (single-colour or colourless) surface coating agent which covers at least the printing inks (or at least the printing inks without regulatory approval for use in the food industry) which are applied in step d).

In particular, before step d) the shell is at least partially printed with a white printing ink by means of a printing unit or by means of a second digital printing unit.

In particular, the first orientation of the shell is also sensed for this printing, with the result that a correspondingly aligned application of the white printing ink can take place.

In particular, at least before step d), in particular also before the printing by means of the second digital printing unit or by means of the printing unit, at least the outer face or the shell is cleaned and/or surface activated (e.g. by means of a plasma treatment) of at least the outer surface or of the shell. It is therefore possible to improve the wetting by the printing inks or the adhesion of the printing inks to the shell.

A device for manufacturing a printed can lid of a can, in particular of a beverage can, with a digital printing method is furthermore proposed. In particular, the device serves for manufacturing a printed can lid according to the method described above. The shell has an outer face and an inner face. The device comprises at least:

(1) a control unit for processing the printed image;

(2) a feed unit for feeding the shell in a feed direction; and (3) a first digital printing unit with at least one printing head with which the printed image which is made available by the control unit can be printed onto the outer face.

In particular, it is proposed that the shell has, at least on the outer surface, at least one structure which predefines a first orientation of the shell and therefore a first position of a printed image which is to be applied to the outer surface. The device additionally comprises a sensor unit for detecting the first orientation of the shell on the feed unit by means of the control unit; wherein by means of the control unit it is possible to generate a computationally generated (and if appropriate rotated) printed image for the first digital printing unit as a function of the first orientation of the shell which is detected by means of the sensor unit and to apply said printed image to the outer face in the first position with the printing head.

In particular, the device comprises a heating apparatus for heating the shell to a predefinable temperature, with the result that immediately before the printing by means of the printing head the shell is at a temperature of at least 40 degrees Celsius.

The shell is preferably heated to a predefinable temperature of at maximum 120 degrees Celsius, preferably at maximum 100 degrees Celsius.

The device preferably comprises an orientation unit, by means of which the shell can be moved in front of the sensor unit in a lateral direction, perpendicularly with respect to the feed unit and aligned therewith. In particular, after the movement by means of the orientation unit the shell remains in this position until the printing with the printing head.

The statements relating to the method apply equally to the device, and vice versa.

For the first time a method and a device for printing a lid for cans is proposed by which even relatively small batches (of the order of magnitude of 1000 cans or lids) of cans or of lids can be printed cost-effectively. It is also possible to apply individualized printed images to lids of cans with said method and device.

By way of precaution it is to be noted that the numerals used here ("first", "second", "third", . . . ) are predominantly (only) used to differentiate multiple objects, values or processes of the same type, that is to say do not in particular necessarily predefine a dependence and/or sequence of these objects, values or processes with respect to one another. If a dependence and/or sequence is necessary, this is specified explicitly here or becomes clearly apparent to a person skilled in the art on examination of the specifically described embodiment.

Figure 2:
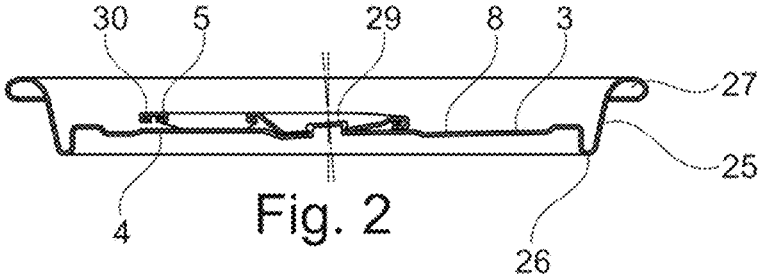
FIG. 2 shows the shell according to FIG. 1 in a side view.

FIG. 1 shows a can lid 1 or shell 2 in a plan view. FIG. 2 shows the shell 2 according to FIG. 1 in a side view. FIGS. 1 and 2 are described together below.

The can lid 1 has an outer face 3 with a circular lid base area and an inner face 4 which is arranged on the opposite side of the can lid 1. The can lid 1 has a core wall 25 and a core bead 26 which is arranged between the lid base area and the core wall 25. At its outer circumference, the can lid 1 has a flanged edge 27 for connection to a can body to form a beverage can.

On the outer face 3 a bead 28 is arranged which is embodied in a non-rotationally symmetrical fashion and serves to reinforce the can lid 1. An opening element 30 which is embodied as a clip is attached to a rivet 29 of the can lid 1. A scoring line 31, by means of which a drink opening or removal opening 13 of the can lid 1 can be opened by the opening element 30 being handled by a user is formed on the outer face 3. The scoring line 31 of the exemplary can lid 1 which is illustrated in FIG. 1 is formed by two parallel lines, the first ends of which are visible, and the second ends of which are, however, arranged underneath the opening element 30.

The opening element 30 forms here a structure 5 which predefines a first orientation 6 of the shell 2 and therefore a first position 7 of a printed image 8 which is to be applied to the outer face 3.

The can lid 1 has on its outer face an area for a printed image 8, which corresponds to the example shown in FIG. 1 essentially to the entire outer face 3 and is also embodied in an (approximately) circular shape. In the example shown in FIG. 1, an upper side of the opening element 30 is completely printed, as is also the rivet 29. In the example illustrated in FIG. 1, the scoring line 31 is also printed to form the part which is not covered by the opening element 30. The part of the scoring line 31 which is arranged under the opening element 30 is not printed.

With the digital printing method proposed here it is possible to print the outer face 3 of the can lid 1 as far as the flanged edge 27.

Figure 3:
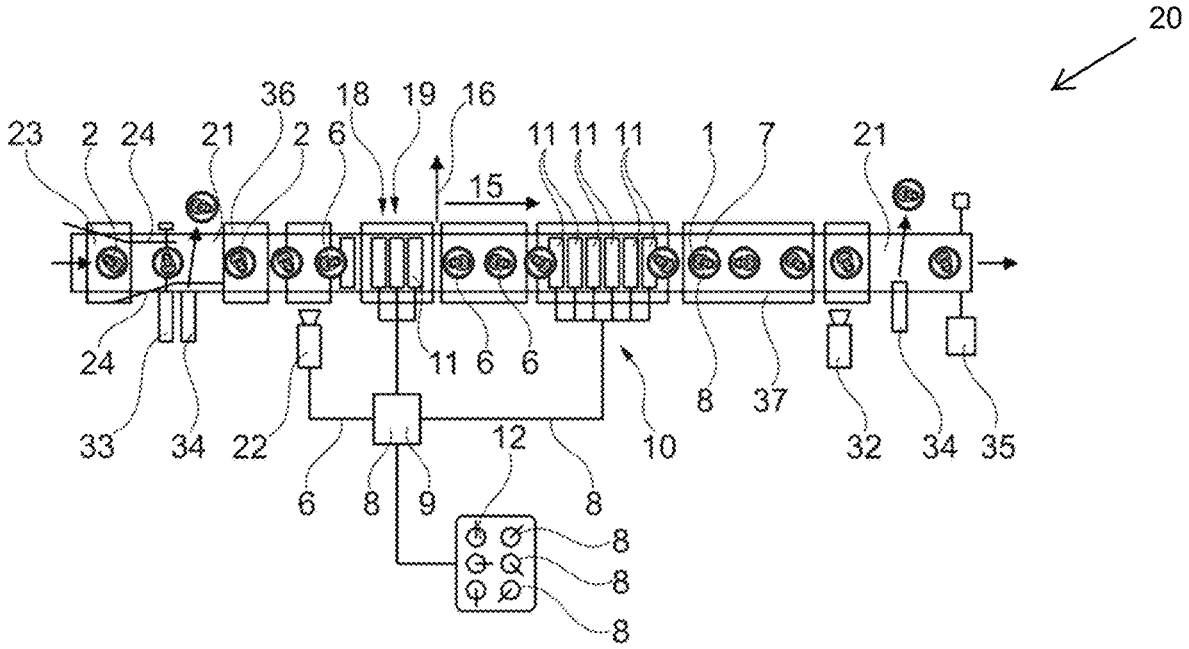
FIG. 3 shows a device in a plan view.

FIG. 3 shows a device 20 for carrying out the proposed method in a plan view. The shell 2 has an outer face 3 and an inner face 4 and at least on the outer face 3 at least one structure 5 which predefines a first orientation 6 of the shell 2 and therefore a first position 7 of a printed image 8 which is to be applied to the outer face 3. The device 20 comprises a control unit 9 for processing the printed image 8, a feed unit 21 for feeding the shell 2 in the feed direction 15, a sensor unit 22 for detecting the first orientation 6 of the shell 2 on the feed unit 21 by means of the control unit 9, and a first digital printing unit 10 with a multiplicity of printing heads 11, with which the printed image 8 which is made available by the control unit 9 can be printed onto the outer face 3 or the can lid 1. By means of the control unit 9 it is possible to generate a computationally generated, rotated printed image 8 for the first digital printing unit 10 as a function of the first orientation 6 of the shell 2 which is detected by means of the sensor unit 22, and to apply said image to the outer face 3 or the shell 2 in the first position 7 with the printing heads.

Furthermore, the device 20 comprises a heating apparatus 23 for heating the shell 2 with the result that immediately before the printing by means of the printing heads 11 the shell 2 is still at a temperature of at least 60 degrees Celsius.

Furthermore, the device 20 comprises an orientation unit 24 by means of which the shell 2 can be moved in front of the sensor unit 22 in a lateral direction 16, perpendicularly with respect to the feed unit 15, and can be aligned therewith, wherein after the movement by means of the orientation unit 24 and until the printing with the printing heads 11 the shell 2 remains in this position and in the first orientation 6.

The device 20 also comprises a first sensor 32 by means of which the applied printed image 8 is checked. If an error is detected here, the affected can lid 1 can be removed from the feed unit 21 by means of the ejection device 34.

Furthermore, the device 20 comprises a second sensor 33 which checks e.g. a height of the can lids 1 which are positioned on the feed unit 21. If a fault is detected here, the affected can lid 1 is also removed from the feed unit by means of an ejection device 34.

The method for manufacturing a printed can lid 1 of a can with a digital printing method comprises the following steps which are carried out by means of the device 20. According to step a) a shell 2 with a structure 5 is made available, wherein the structure 5 predefines a first orientation 6 of the shell 2 and therefore a first position 7 of a printed image 8 which is to be applied to the outer face 3. According to step b) a control unit 9 and a printed image 8 are made available, wherein the printed image 8 can be processed in the control unit 9. According to c) a first digital printing unit 10 is made available with a multiplicity of printing heads 11, wherein a printed image 8 which is made available by the control unit 9 can be printed onto the outer face 3 or the shell 2 with the printing heads 11. In step a1), the first orientation 6 of the shell 2 is sensed by means of the control unit 9. In step b1), a first position 7 of the printed image 8 which is to be applied is determined by means of the control unit 9 as a function of the detected first orientation 6. In step c1), a printed image 8 which is generated, if appropriate rotated computationally, as a function of the first determined position 7 of the printed image 8 is made available for the first digital printing unit 10. In step d), the rotated printed image 8 which is made available by the control unit 9 is printed onto the outer face 3 in the first position 7 with the printing heads 11.

In step a1), the first orientation 6 of the shell 2 is sensed or detected by means of the control unit 9. The sensing or detection of the first orientation 6 is carried out using a sensor unit 22 whose measurement signal is sensed and processed by means of the control unit 9. An optical sensor, by means of which e.g. the position of an opening element 30 is sensed, is preferably used here.

In step c1), a printed image 8 which is generated (and if appropriate rotated) computationally in the control unit 9 as a function of the first orientation 6 of the shell 2 is made available for the at least one first digital printing unit 10.

In contrast to known methods, the shell 2 is not rotated or moved here in such a way that the printed image 8 can always be applied in the same way to the shell 2. It is proposed here that the printed image 8 be oriented (in a virtual fashion) in the control unit 9 in such a way that it can then be applied with the suitable orientation by means of the printing heads 11 to the (always differently) oriented shell 2.

Therefore, a movement of the shell 2, e.g. a rotation of the shell 2 or lateral shifting is not necessary before the printing in the first digital printing unit 10. An adaptation of the position of the printing head 11 or of the first digital printing unit 10 is also not necessary, since a "rotated data record" or a "laterally offset data record" which is made available by the control unit 9 of the printing image 8 is applied to the shell 2.

The shells 2 are fed to the first digital printing unit 10 at a speed of at least 30 metres per minute. In the time between the sensing of the first orientation 6 in step a1) (at the sensor unit 22) and the making available of the rotated (and/or laterally shifted) printed image 8 according to step c1) the shell 2 may have traveled at maximum the distance e.g. between the sensor unit 22 which is used in step a1) and the first digital printing unit 10.

Alternatively, there are a multiplicity of printed images 8 which are each rotated by a pre-defined angular value 12 (and/or which are offset laterally by a value) in the control unit 9, wherein in step c1) a printed image 8 which is oriented in a way matching the first orientation 6 is selected by means of the control unit 9 and made available for the first digital printing unit 10.

During the printing according to step d), the printing heads 11 are arranged with respect to the outer face 3 or to the shell 2 in such a way that at least one partial surface 14, to be printed, of the outer face 3 is at least two millimetres away from each printing head 11 during the printing. In particular, this distance (measured essentially in a direction in which the printing ink moves from the printing head 11 to the partial surface 14) of the printing head 11 from the outer face 3 is necessary for no contact to occur between the printing head 11 and the shell 2 in the other areas of the shell 2, e.g. at places where the structure 5 is arranged.

The first digital printing unit comprises here six printing heads 11, wherein each printing head 11 applies a different printing ink.

After step d), the applied printing ink is visibly dried by means of heat, e.g. as a result of drying with hot air or of infrared drying in a drying unit 37.

Between the steps a1) and d) the shell 2 is fed to the first digital printing unit 10 in a feed direction 15, wherein only before step a1) the shell 2 is moved in a lateral direction 16, perpendicularly with respect to the feed direction 15, and is aligned therewith. This movement or orientation in the lateral direction 16 positions the shell 2 under the at least one printing head 11 in such a way that the printed image 8 can be applied in each case in a centred fashion on the shell 2.

The movement or orientation is carried out by means of guide devices or guide rails of an orientation unit 24 which shift the shell 2 on the feed unit 21.

The feed unit 21 comprises a conveyor belt on which the shells 2 are secured e.g. by means of the application of a partial vacuum. A movement of the shell 2 with respect to the feed unit 21 can then be carried out only by means of external force, e.g. by means of guide devices or guide rails of the orientation unit 24 by means of the ejection devices 34.

The shell 2 is at least partially printed here before step d) by means of a printing unit 18 or by means of a second digital printing unit 19, with a white printing ink as a primer coat by means of three printing heads 11 here.

The first orientation 6 of the shell 2 is also sensed for this printing, with the result that a correspondingly oriented application of the white printing ink can be carried out.

In addition, at least before step d), and here also before the printing by means of the second digital printing unit 19 or by means of the printing unit 18, at least the outer face 3 or the shell 2 is cleaned and/or surface activated (e.g. by means of a plasma treatment) by means of a cleaning unit 36.

Figure 4:
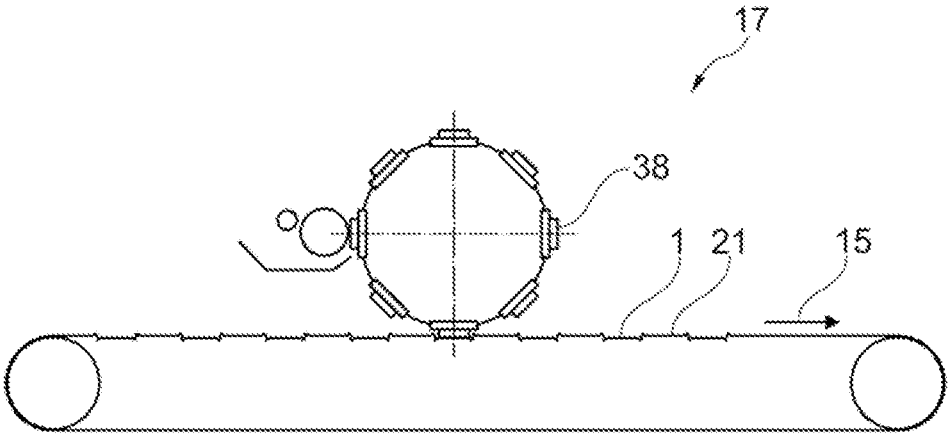
FIG. 4 shows a further device in a side view.

FIG. 4 shows a further device in a side view. This further device comprises a pad-printing unit 17 to which the shell 2 is fed by means of the feed unit 21 after step d), wherein the printed image 8 is coated over by means of the pad-printing unit 17. In the pad-printing method, a printed image 8 is applied, by means of a deformable compression die 38, to a surface which is to be printed on (the shell 2 or the can lid 1). The surface to be printed on does not have to be flat here but rather can have depressions and elevated portions. This is made possible by the deformable compression die 38 which is composed of a soft, elastic material and is designed to deform when in contact with a surface to be printed, and in this case transfer previously absorbed printing media, e.g. printing inks or surface coating agents, to the surface to be printed.

Here, a (single-coloured or colourless) surface coating agent which covers at least the printing inks applied in step d) (or at least the printing inks without regulatory approval for use in the food industry).

LIST OF REFERENCE NUMBERS

1 Can lid
2 Shell
3 Outer face
4 Inner face
5 Structure
6 First orientation
7 First position
8 Printed image
9 Control unit
10 First digital printing unit
11 Printing head
12 Angular value
13 Removal opening
14 Partial surface
15 Feed direction
16 Lateral direction
17 Pad-printing unit
18 Printing unit
19 Second digital printing unit
20 Device
21 Feed unit
22 Sensor unit
23 Heating apparatus
24 Orientation unit
25 Core wall
26 Core bead
27 Flanging edge
28 Bead
29 Rivet
30 Opening element
31 Scoring line
32 First sensor
33 Second sensor
34 Ejection device
35 Motor
36 Cleaning unit
37 Drying unit
38 Compression die

The invention claimed is:

1. Method for manufacturing a printed can lid of a can with a digital printing method; comprising at least the following steps:

(a) making available a shell with an outer face and an inner face, wherein the shell has, at least on the outer face, at least one structure which predefines a first orientation of the shell, and therefore a first position of a printed image which is to be applied to the outer face;

(b) making available a control unit and a printed image, wherein the printed image can be processed in the control unit, and wherein in the control unit there are a multiplicity of printed images which are each rotated by a predefined angular value;

(c) making available at least a first digital printing unit with at least one printing head; wherein the printed image which is made available by the control unit can be printed onto the outer face with the printing head;

(d) detecting the first orientation of the shell by the control unit;

(e) determining a first position of the printed image which is to be applied, as a function of the detected first orientation; and (f) making available a printed image which is generated computationally as a function of the first position in the control unit, for the at least one first digital printing unit, wherein a printed image which is oriented in a way matching the first orientation by the control unit is selected and is made available for the first digital printing unit; and (g) printing the printed image which is made available by the control unit onto the outer face with the printing head, wherein the printed image which is made available by the control unit is printed onto the outer face in the first position with the printing head.

2. Method according to claim 1, wherein in step (f) the printed image is rotated computationally by the control unit.

3. Method according to claim 1, wherein the predefined angular values of the printed images, which are present in the control unit, differ by at maximum 5 angular degrees in each case.

4. Method according to claim 1, wherein the at least one structure is an opening element; wherein a removal opening in the can lid can be opened by a user by the opening element.

5. Method according to claim 1, wherein the at least one printing head is arranged with respect to the outer face in such a way that at least one partial surface, to be printed, of the outer face is moved at least two millimetres away from the printing head during the printing.

6. Method according to claim 1, wherein the shell has, directly before the printing according to step d), a temperature of at least 40 degrees Celsius.

7. Method according to claim 1, wherein the first digital printing unit comprises at least four printing heads, wherein each printing head applies a different printing ink.

8. Method according to claim 1, wherein water-based colors are applied by the first digital printing unit.

9. Method according to claim 1, wherein between the steps (d) and (g), the shell is fed to the first digital printing unit in a feed direction, wherein only before step (d) the shell is moved in a lateral direction, perpendicularly with respect to the feed direction, and is aligned therewith.

10. Method according to claim 1, wherein after step (g) the shell is fed to a pad-printing unit, wherein the printed image is coated over by the pad-printing unit.

11. Method according to claim 1, wherein before step (g) the shell is at least partially printed with a white printing ink by a printing unit or by a second digital printing unit.

12. Method for manufacturing a printed can lid of a can with a digital printing method; comprising at least the following steps:

(a) making available a shell with an outer face and an inner face, wherein the shell has, at least on the outer face, at least one structure which predefines a first orientation of the shell, and therefore a first position of a printed image which is to be applied to the outer face;

(b) making available a control unit and a printed image, wherein the printed image can be processed in the control unit;

(c) making available at least a first digital printing unit with at least one printing head; wherein the printed image which is made available by the control unit can be printed onto the outer face with the printing head;

(d) detecting the first orientation of the shell by the control unit;

(e) determining a first position of the printed image which is to be applied, as a function of the detected first orientation; and (f) making available a printed image which is generated computationally as a function of the first position in the control unit, for the at least one first digital printing unit; and (g) printing the printed image which is made available by the control unit onto the outer face with the printing head, wherein the printed image which is made available by the control unit is printed onto the outer face in the first position with the printing head;

wherein between the steps (d) and (g) the shell is fed to the first digital printing unit in a feed direction, wherein only before step (d) the shell is moved in a lateral direction, perpendicularly with respect to the feed direction, and is aligned therewith.

* * * * *